US011661755B2

(12) United States Patent
Liistro

(10) Patent No.: US 11,661,755 B2
(45) Date of Patent: May 30, 2023

(54) PRECAST BRICK PANEL AND METHOD OF MANUFACTURE

(71) Applicant: Brickworks Building Products Pty Ltd, Horsley Park (AU)

(72) Inventor: Roberto Sebastian Liistro, Horsley Park (AU)

(73) Assignee: Brickworks Building Products Pty Ltd, Horsley Park (AU)

( * ) Notice: Subject to any disclaimer, the term of this patent is extended or adjusted under 35 U.S.C. 154(b) by 320 days.

(21) Appl. No.: 16/825,120

(22) Filed: Mar. 20, 2020

(65) Prior Publication Data

US 2020/0299981 A1 Sep. 24, 2020

(30) Foreign Application Priority Data

Mar. 21, 2019 (AU) ..... 2019900955

(51) Int. Cl.

| | |
|---|---|
| ***E04G 21/20*** | (2006.01) |
| ***E04G 21/22*** | (2006.01) |
| ***E04C 2/04*** | (2006.01) |
| ***B28B 19/00*** | (2006.01) |
| *E04C 2/00* | (2006.01) |
| *E04B 2/02* | (2006.01) |

(52) U.S. Cl.

CPC ..... *E04G 21/22* (2013.01); *E04G 21/20* (2013.01); *B28B 19/0061* (2013.01); *E04B 2002/0282* (2013.01); *E04C 2/042* (2013.01); *E04C 2002/007* (2013.01)

(58) Field of Classification Search

CPC ... E04G 21/20; E04G 21/22; E04C 2002/007; E04C 2/041; E04C 2/042; B28B 19/0061; B28B 19/0053; E04B 2002/0282; B65G 47/06; B65G 47/08; B65G 47/082

See application file for complete search history.

(56) References Cited

U.S. PATENT DOCUMENTS 3,162,982 A 12/1964 Monk, Jr.
3,248,836 A 5/1966 Monk et al.
(Continued)

FOREIGN PATENT DOCUMENTS

CN 108481300 A * 9/2018 ..... B25J 19/022
CN 208323379 U * 1/2019
(Continued)

OTHER PUBLICATIONS

U.K. Search Report dated Sep. 14, 2020, for GB 2004072.1.

*Primary Examiner* — Ryan D Kwiecinski
(74) *Attorney, Agent, or Firm* — Womble Bond Dickinson (US) LLP

(57) ABSTRACT

A method for assembling a brick pattern for forming a precast brick panel. The method includes conveying bricks in a row to a spacing station, spacing the bricks apart in a row at the spacing station according to a predetermined row pattern and to a predetermined row length by allowing the spacing between adjacent bricks to vary if required. The method then involves transferring the row of spaced bricks onto a generally planar support surface of a brick pattern assembly station. By this method, a plurality of rows of spaced bricks are assembled adjacent each other on the support surface of the brick pattern assembly station to form a brick pattern.

17 Claims, 4 Drawing Sheets

(56) References Cited

U.S. PATENT DOCUMENTS

| | | | | | |
|---|---|---|---|---|---|
| 3,789,101 | A * | 1/1974 | Wright | E04C 2/041 | 264/261 |
| 3,933,570 | A * | 1/1976 | Wright | E04C 2/042 | 156/182 |
| 4,008,796 | A * | 2/1977 | Aylon | E04G 21/202 | 198/460.1 |
| 4,067,766 | A * | 1/1978 | Larger | E04C 2/042 | 52/749.14 |
| 4,429,499 | A | 2/1984 | Kato | | |
| 5,366,066 | A * | 11/1994 | Boot | E04C 2/042 | 198/458 |
| 6,421,974 | B1 | 7/2002 | Whitehouse et al. | | |

FOREIGN PATENT DOCUMENTS

| | | | | | |
|---|---|---|---|---|---|
| CN | 208496970 | U * | 2/2019 | B25J 19/022 | |
| DE | 2215661 | A1 | 10/1973 | | |
| DE | 2359428 | A1 | 6/1975 | | |
| DE | 19828812 | A1 * | 1/2000 | E04C 2/042 | |
| DE | 19829418 | A1 * | 1/2000 | E04C 2/042 | |
| DE | 19839132 | A1 * | 3/2000 | E04C 2/042 | |
| DE | 19839132 | A1 | 3/2000 | | |
| GB | 2 443 806 | A | 5/2008 | | |
| GB | 2 455 284 | A | 6/2009 | | |
| JP | H05229651 | A * | 9/1993 | | |
| NL | 9201312 | A * | 2/1994 | E04G 21/22 | |
| WO | WO 92/10626 | A1 | 6/1992 | | |
| WO | WO 2011/085447 | A1 | 7/2011 | | |
| WO | WO 2013/174495 | A2 | 11/2013 | | |
| WO | WO-2013174495 | A2 * | 11/2013 | B28B 17/0081 | |

* cited by examiner

PRECAST BRICK PANEL AND METHOD OF MANUFACTURE

CROSS-REFERENCE TO RELATED APPLICATION

The present application claims priority under 35 U.S.C. § 119(a) to Australian Application No. 2019900955, which was filed on Mar. 21, 2019.

INCORPORATION BY REFERENCE

The entire disclosure of Australian Application No. 2019900955, which was filed on Mar. 21, 2019, is incorporated by reference herein as if presented herein in its entirety.

TECHNICAL FIELD

The present invention relates to a precast brick panel comprising a body of bricks embedded in mortar or cement and a method of manufacturing such a panel for use in the construction of walls for buildings, such as domestic or commercial dwellings. The present invention is particularly directed to a method of assembling bricks prior to embedding in mortar or cement.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Brick walls are typically constructed on-site by bricklayers, who progressively lay individual bricks in successive brick courses or rows on a bed of mortar laid on the previous course. The brick wall is thus constructed vertically from the ground up. The brick laying process can be slow and tedious and can add significantly to the time and cost of constructing a building. Brick walls that are under construction can also present a safety hazard until the wall is completed and the mortar cured. The construction of a wall in this manner is also subject to weather conditions, such that during rain or snow, or in extreme heat, construction is normally halted. Brick laying also requires skilled labour, but access to that labour is gradually decreasing with the decline in interest the brick laying trade as a career. These issues can drive builders to select non-brick wall alternatives.

An alternative to the manual laying of individual bricks as described above, is to form brick panels, in which bricks are embedded in a cement base and whereby multiple panels can be used to construct a wall. Brick panels of this kind have been contemplated and even formed before and for example, the prior art includes the manual laying of bricks in formwork into which cement or cementitious material is subsequently poured. The formation of brick panels by this manual laying method has not generally been successful, as a result of relatively high cost and low productivity, while the accuracy of brick placement has also been an issue. The panels formed in this manner have thus not met commercial success mainly due to cost, quality and low output issues.

The present applicant is associated with Australian Patent 2011206926, which discloses a brick panel including a plurality of bricks embedded in a body of cementitious material and a method of forming such a brick panel. This patent discloses forming brick panels utilising jigs or templates to position the bricks so that the skill required to lay the bricks is reduced to a relatively unskilled role. The panels can also be formed remotely in a factory so that weather does not hinder manufacture and the panels can be produced across 24 hour shifts, i.e. into or even through the night as required to meet order volumes. Once formed, the panels can be transported to the building site and lifted into place. Advantageously, the construction of brick walls in this manner can increase the speed at which a building wall can be constructed compared to construction by manual laying of bricks.

In other prior art, British patent GB 2,455,284 discloses a brick faced cement panel, in which half sized bricks are moulded into the front face of a cement panel. This patent discloses a method of forming a prefabricated panel having a predetermined pattern of half bricks moulded into a body of cement. The method comprises the steps of providing a mould and a template which defines a pattern for loading the bricks into the mould. Once loaded, cement is poured into the mould about the bricks and once cured, the panel is ready for installation. This method produces a precast brick panel but is labour intensive by the requirement for the manual placement of bricks into the mould within the template.

U.S. Pat. No. 6,421,974, discloses a panel in which brick tiles are formed with a shape which enables connection to a steel backing. When constructing a wall, the steel backing is first secured in place and thereafter the brick tiles are clipped into place on the backing. The system of U.S. Pat. No. 6,421,974 is suitable only where cladding is required, rather than a supporting or structural wall, but the system does remove the need for the application of mortar and is faster than traditional bricklaying. However, the panel is constructed on-site and thus adverse weather conditions can still interrupt the construction process. Also, because the wall is a cladding only, it is not suitable for many applications.

Applicant's view is that precast brick panels have not been developed to a satisfactory commercial form at present and accordingly, they have not attracted widespread use.

The present invention therefore proposes a new and innovative precast brick panel, an installation for and a method of producing a precast brick panel which differs from prior art installations and methods of forming precast brick panels and which provides advantages as will be explained herein. In particular, the present invention proposes to provide a brick panel that is more likely to be commercially acceptable in the construction industry or the building trade.

SUMMARY OF INVENTION

The present invention provides an installation for assembling a brick pattern for forming a precast brick panel, the installation comprising:

a. a conveyor, b. a spacing station, and c. a brick pattern assembly station, the conveyor being operable to convey a row of bricks to the spacing station, and the spacing station being operable to space the bricks apart in a row according to a predetermined row pattern and to a predetermined row length by allowing the spacing between adjacent bricks to vary if required, once spaced apart according to the predetermined row pattern, the installation facilitating transfer of the row of spaced bricks onto a generally planar support surface of the brick pattern assembly station on which a plurality of rows of spaced bricks are assembled adjacent each other to form a multiple row brick pattern.

The present invention provides a method for assembling a brick pattern for forming a precast brick panel, the method comprising:

a. conveying bricks in a row to a spacing station, b. spacing the bricks apart in a row at the spacing station according to a predetermined row pattern and to a predetermined row length by allowing the spacing between adjacent bricks to vary if required, c. transferring the row of spaced bricks onto a generally planar support surface of a brick pattern assembly station, whereby a plurality of rows of spaced bricks are assembled adjacent each other on the support surface of the brick pattern assembly station to form a brick pattern.

The following discussion relates to both the installation and method, so that all alternatives that are given can apply to each of the installation and method.

An installation and method of the above kind has been tested and has produced a multiple row brick pattern of very high accuracy for later embedding in a body of cement or cementitious material. Advantageously, the spacing station is operable to space apart individual bricks in the row of bricks so that the lengthwise dimension of the row is continuously very accurate row after row. This is different to the manual placement of individual bricks and is also different to the use of jigs or templates, because advantageously, the spacing station can accommodate the slight variation that occurs in the lengths of different bricks, which is not possible, or is more difficult when the bricks are placed manually or with the use of jigs or templates. The outcome is that multiple rows of bricks can be produced to a very high length accuracy so that the side edges of multiple rows of spaced bricks are accurately aligned, which is important for the aesthetic appearance of a precast brick panel.

In addition, the accuracy of the length of each row of spaced bricks and the later accuracy with which the rows of spaced bricks can be aligned adjacent each other at the brick pattern assembly station, means that the precast brick panel can be highly aesthetic. The aesthetic appearance is expected to be improved over prior art precast brick panels as previously formed and also over hand laid bricks. In hand laying bricks, the brick layer can compensate for a brick row that is appearing during formation to be too long or too short, by making spacing adjustments to the bricks that are yet to be laid, which normally are the bricks that are towards the end of the row. This requires the judgement of the brick layer to recognise that compensation is necessary and then to make that compensation appropriately with the bricks that remain to be laid in a particular row. The bricks in the row may therefore have exaggerated spacing or closer spacing towards one end of the row to provide the required compensation to form a row of the correct length. In contrast, the present invention applies appropriate spacing across the entire row, so that exaggerated spacing or closer spacing towards one end of a row is not required. Thus there is uniformity to the spacing between bricks along the whole row, or at least the spacing between bricks of each row is as initially specified or designed from one end of the row to the other, rather than the spacing varying for compensation purposes towards one end of a row.

A still further advantage of the invention is that the spacing station can produce openings in the brick pattern that are required to accommodate windows and doors, or other components that are required to extend through the precast brick panel—a letter box or meter box for example. These openings are produced by creating larger spaces between adjacent bricks (such as a space equivalent to two or three bricks) in the rows of spaced bricks where the opening is to be provided. Thus, the spacing station can space bricks in rows of spaced bricks at any suitable spacing depending on whether openings in the precast brick panel are to be provided or not. Also, where an opening is to span two or more rows of bricks, the conveyor can convey half bricks to every second row in which the opening is to be formed so that the edges of the opening between rows are aligned. Thus, the invention extends to allowing specific forms of bricks to be selected to create the particular form of row required. The bricks typically will be full size or half size brick (or full length or half length bricks) but the invention can accommodate other sizes of bricks as may be used in a precast brick panel. The invention can also accommodate the selection of different bricks for placement in a row of bricks. The bricks may be the same size, but might be of a different colour, or texture for example, in order to create a particular pattern or appearance in the brick panel as specified for construction.

The conveyor of the installation of the invention can be of any suitable kind. The conveyor is required to deliver to the spacing station a row of bricks but it is not required to accurately space the bricks. Also, the bricks can be out of lengthwise or axial alignment as that misalignment can be corrected either at the spacing station or at the brick pattern assembly station. Where the bricks are rectangular, the bricks would ordinarily be delivered to the spacing station generally aligned along their longitudinal axis. The bricks will normally mostly be full size bricks, but half size bricks are also used, as can other sized bricks (although the use of bricks other than full or half size is unlikely to be common). Half size bricks are often used at the end of a brick row or at the edge of an opening in a brick row, given that adjacent rows of bricks are usually offset by half the length of one brick, so that a half-length or half size brick, usually a substantially square brick, is inserted at the end of every second row of bricks to take up the offset at each end of the row, or to take up the offset at the edge of an opening so that the edges of the between rows are aligned. In some forms of the invention therefore, the conveyor delivers different sized bricks, usually full size and half size bricks, to the spacing station, in an order to fill spaces created by the offset between adjacent rows of bricks.

The conveyor can be fed manually such as by factory personnel, or more preferably by an automated feed facility that feeds bricks onto the conveyor in an orientation suitable to be spaced by the spacing station. As indicated above, the orientation would usually be in lengthwise or axial alignment. In some forms of the invention, the conveyor is fed by a feed facility that comprises a robotic placement arrangement in which bricks are picked up from a brick supply by a robot and are placed on the conveyor. The robot can pick up individual bricks and place them individually on the conveyor, or the robot can pick up multiple bricks for placement. The robot can pick up multiple full size bricks and individual half size bricks for example, to complete a row of bricks for dispatch to the spacing station. The robot needs only to pick up the bricks and to place them in the appropriate order for conveying to the spacing station as it is at the spacing station that the bricks are spaced apart properly.

The full size bricks can be located in a different position in or relative to the feed facility to the half size bricks and the robot can work between the two locations. The robot can be arranged to pick a plurality of full size bricks and then to pick a half size brick and then to place the group of bricks on the conveyor in correct order for spacing. In this respect, the order in which full size and half size bricks are placed on the conveyor for dispatch to the spacing station is important for ensuring that the pattern of bricks that is formed at the brick pattern assembly station is the correct pattern. In fact, the pattern is established by the order of the bricks that are supplied to the spacing station by the conveyor. Thus, the robot can be appropriately programmed to select the appropriate order of bricks to produce a particular brick pattern. Many different brick patterns can be programmed. These patterns can include openings of the kind discussed above and can include different colour or texture of bricks.

The spacing station can space the bricks in any suitable manner. The spacing station is not required to order the bricks as this has already been completed in the preceding part of the installation or method when the bricks are selected and are conveyed to the spacing station. In one form of the invention, the spacing station incorporates a sensing arrangement that senses the forward or leading (header) ends or faces of the bricks being assembled into a row. The spacing station then spaces the forward ends of adjacent bricks apart a selected amount. The actual length of each brick is not measured and the spacing between adjacent bricks is not a fixed and consistent dimension, but the effect is that the spacing between the forward ends of adjacent bricks in a row of bricks is a fixed and consistent dimension.

This manner of spacing adjacent bricks by sensing the forward ends of the bricks being assembled into a row has been found to be highly advantageous in forming brick rows of consistent length. Advantageously, this allows the length of a brick row to be accurately formed despite the tolerance variations that occurs in individual bricks that has been discussed above, and for that accuracy to be repeated over multiple brick rows. In this form of the invention, the spacing between facing rear and front faces of adjacent bricks can vary through the length of the brick row to accommodate the tolerance variations in individual bricks in order for the overall length of the brick row to be consistently the same over multiple rows. Thus, the length of brick rows formed in this manner can be accurately repeated over and over.

Once the forward end of a brick which is conveyed to the spacing station has been sensed, the brick can be shifted forward a predetermined distance relevant to the spacing required between bricks in the row of bricks being assembled and the length of the bricks. The first, initial or leading brick of a row of bricks that is being assembled establishes one side edge of the row and the following or subsequent bricks are assembled relative to the initial brick. The initial brick can be placed or located at a datum point in the spacing station from which the subsequent bricks are spaced. In some forms of the invention, the initial brick can be delivered to engage a datum point in the form of an abutment in the spacing station and the next brick can be the subject of the sensing described above. The benefit of a physical abutment is that the same starting point for an initial brick of a row can be easily achieved for each row that is formed in the spacing station.

In one form of the invention, the initial brick is placed at or delivered to a datum point whereby the position of the initial brick within the spacing station is established. In particular, the position of the leading end or face of the initial brick is known. This is important, because in this form of the invention, the spacing station operates to space adjacent bricks apart with reference to the spacing between the respective leading ends or faces of adjacent bricks, rather than between the trailing end of one brick and the leading end of an adjacent brick. The present invention operates on the basis that the spacing between facing trailing and leading ends of adjacent bricks can be allowed to vary to accommodate variations in the lengths of adjacent bricks, in order for the overall length of the row of bricks to have an accurate and a repeatable dimension. This differs from other prior art arrangements in which a set spacing between the trailing end of one brick and the leading end of an adjacent brick is made, such as by using a physical spacer between bricks or a template to place the bricks, so that the length of one row of bricks might differ from the length of another row of bricks by the accumulation in a brick row of slight differences between the lengths of the bricks.

For example, while an average length of a full size brick might be 230 mm, the manufacturing process to produce a brick has a tolerance in the order of 2 or 3 mm so that the actual length of a full size brick might be 227 mm or 233 mm, or somewhere in between. If bricks are laid in a row with a consistent spacing between them, say of 10 mm (which is typical), one row of bricks will never be the same length as another row of bricks. The difference in overall length can be small, but it can nevertheless be evident and can affect the aesthetic appearance of the brick wall by the edges of the wall being slightly offset from one row to the next. The applicant is of the view that maintaining accuracy in the overall length of the rows of a brick wall produces a wall of better aesthetic appearance than maintaining accuracy in the spacing between individual bricks in each row. In applicant's view, it is visually more difficult to ascertain differences in the spacing of individual bricks in a row of bricks as compared to ascertaining differences in the overall length of the rows of a brick wall.

It follows that the invention seeks to produce rows of bricks in which the length of each row is the same but the spacing between adjacent bricks can vary slightly as required, to accommodate variations in the lengths of the bricks within the row.

The spacing station is thus operable to position the initial brick in place and to deliver a subsequent or next brick to a position adjacent to and facing the initial brick but which is spaced from the initial brick. The spacing station does this by establishing the position of the leading end or face of the initial brick and then by bringing the leading end or face of the next brick to a position spaced from the leading end or face of the initial brick a predetermined amount, which amount is, in some forms of the invention, the sum of the average length of the bricks forming the row plus an average mortar gap. The actual length of the initial brick is thus not relevant.

As an example, for a full size brick of average length of 230 mm±3 mm, the spacing of the leading end of the next brick from the leading end of the initial brick could be predetermined to be 240 mm, being the average length of 230 mm plus an average mortar gap of 10 mm. Thus the spacing station shifts the next brick towards the initial brick until the 240 mm spacing between the respective leading ends of the bricks has been achieved. The gap or spacing between the bricks will be 10 mm if the initial brick has an actual length of 230 mm, but if the initial brick has a length of 227 mm or 233 mm for example, then the gap will be 13 mm or 7 mm respectively. While the gap can vary, there is consistency in the spacing between the leading ends of the initial and next bricks. This ability to accommodate different lengths of brick is important to the invention as it enables the invention to deliver rows of bricks that have an overall equal length dimension, regardless of length variations between individual bricks in each row.

The process repeats itself with each new brick, in that with the position of the leading end of each already positioned brick known, the leading end of the next brick can be introduced at a spacing that is 240 mm from the leading end of the already positioned brick and so the length of the already positioned brick is not important. The process repeats itself until the row of bricks is complete and the row is conveyed or dispatched to the brick pattern assembly station.

The spacing station can include a robot that places bricks in the manner discussed above. The placement can be on a conveyor so that once the row is complete, the row can be conveyed to the brick pattern assembly station. The row being assembled can move forward as each new brick is added to the row.

Alternatively, the spacing station can employ two conveyors comprising a delivery conveyor and a spacing conveyor. The delivery conveyor delivers bricks to the spacing station and the spacing conveyor delivers spaced bricks away from the spacing station. The delivery and spacing conveyors can operate together to space the bricks appropriately.

In some forms of the invention, the spacing conveyor includes an abutment for engagement by an initial brick. This abutment forms the datum point for the initial brick that is discussed above. The abutment can be a retractable abutment that remains in place only to engage the initial brick and thereafter is retracted so as not to impede subsequent movement of the initial brick and subsequent bricks. The abutment can be repositionable to accommodate bricks of different size, such as half and full bricks, or multiple abutments can be provided, each appropriate for a different sized brick. Thus, if a row is to commence with a half brick, a different abutment can be deployed compared to a row that commences with a full brick. The initial brick can be conveyed along the delivery conveyor and onto the spacing conveyor where it engages the abutment and at which point movement of the initial brick terminates. Movement of the spacing conveyor can also terminate so that the abutment can be withdrawn and the initial brick remains in place at the point at which it engaged the abutment. Because the initial brick has engaged the abutment, the position of the leading end or face of the initial brick is known or established.

With the initial brick in place, the next brick can be delivered on the delivery conveyor and forward movement of that brick occurs until the leading end of the next brick reaches the predetermined spacing from the leading end of the initial brick. A sensor can be positioned at the point along the delivery or spacing conveyor to sense when the leading end of the next brick reaches the predetermined spacing. Once the next brick has reached the predetermined spacing, either or both of the delivery and spacing conveyors can operate to shift the initial and next bricks together forward, so that the spacing between them remains as initially set.

The delivery and spacing conveyors can operate independently or together. For delivery of the initial brick to the datum point (the abutment for example) the delivery and spacing conveyors might each rotate and at the same speed. The initial brick will travel along the delivery conveyor to the end of that conveyor and will transfer to the spacing conveyor. The delivery and spacing conveyors can be aligned so that they present a linear or straight conveying surface and facing ends of the respective conveyors can be closely spaced apart so that the distance that a brick is required to bridge between the conveyors, or to move from the delivery conveyor to the spacing conveyor, is small. The brick can simply transfer from the delivery conveyor to the spacing conveyor by the delivery conveyor continuing to convey the brick until the spacing conveyor commences conveying the brick.

The initial brick will engage the abutment or otherwise cease movement at the datum point. The leading face of the initial brick will have thus been established. The delivery conveyor can cease conveying movement when the initial brick shifts onto the spacing conveyor and the spacing conveyor can commence movement as soon as the initial brick leaves the delivery conveyor. Alternatively, the delivery conveyor can continue conveying movement such as at a consistent pace so that subsequent bricks already loaded onto the delivery conveyor continue to move towards the spacing conveyor. For this, the bricks can be loaded onto the delivery conveyor spaced sufficiently apart to allow a brick to be spaced on the spacing conveyor before the next brick is delivered to the spacing conveyor.

The spacing conveyor can stop and start while the delivery conveyor can operate at a constant or consistent speed or pace. Once the bricks leave the delivery conveyor completely and therefore are located completely on the spacing conveyor, they remain stationary or fixed relative to each other and so the spacing needs to occur between or at the transition from the delivery conveyor to the spacing conveyor. The spacing conveyor can thus be programmed to commence movement as soon as the delivery conveyor has delivered a brick to a point at which the spacing between the respective leading ends of two adjacent bricks has reached the predetermined dimension, so that up until that point, the spacing conveyor remains stationary and any bricks already loaded onto the spacing conveyor also remain stationary. The delivery conveyor thus moves a brick towards the spacing conveyor and towards the last brick on that conveyor (which can be the initial brick or a subsequent brick) and the distance between the last brick and the incoming brick reduces until the predetermined dimension is reached. At that point, the spacing conveyor can commence movement (which can largely be instantaneous movement) to the same speed or pace as the delivery conveyor, so that no further relative movement occurs between the two bricks (being the last brick on the spacing conveyor and the incoming brick being delivered on the delivery conveyor). Any lag that occurs in the commencement of movement of the spacing conveyor can be compensated for in the programming of the relative movements of the delivery and spacing conveyors. Once the incoming brick has fully transitioned to the spacing conveyor, the spacing conveyor can cease movement while awaiting the next incoming brick. This is repeated until the brick row has been fully formed.

It follows that the initial brick and the next brick (hereinafter the "second brick") move forward to a position for a subsequent or third brick to be positioned in the brick row being formed. The leading end of the third brick is moved via the delivery conveyor to a position which is at a predetermined spacing from the leading end of the second brick, such as at 240 mm from the leading end of the second brick. At that position, the initial brick and the second and third bricks are moved forward to a position for a fourth brick to be introduced into the brick row, and so on.

As an example, in a row of bricks that comprises 10×230 mm average length bricks with a 10 mm mortar gap between each brick, the overall length of the row would be 2390 mm. However, if the bricks are not all exactly 230 mm in length, then the length of the row will vary from 2390 mm. For example (and this is a theoretical example only to illustrate the point), if one row consists of 10×228 mm length bricks and the adjacent row consists of 10×232 mm length bricks, and the gap between each brick is maintained at 10 mm, the variation in row length will be 40 mm. However in the present invention, the row lengths will be the same, because the gap between each brick will be varied instead. In the row of 10×228 mm length bricks, the gap between each brick will be about 12 mm to give a row length of 2390. In the row of 10×232 mm length bricks, the gap between each brick will be about 8 mm to give a row length of 2390. Applicant is of the view that the small difference in the gap between the bricks of the two rows is difficult to visually identify and is more aesthetically pleasing than a 40 mm difference in the overall length of the two rows.

Of course, it will not be the case that each brick in a row of bricks will be the same length as given in the example above. Rather, there will be a range or mix of different length dimensions about the average dimension of 230 mm and as a result, the difference in row length without the compensation that is provided by the present invention would vary from row to row.

The spacing station can be programmed to produce rows of bricks that include openings, as well as truncated rows. Thus, the invention is not restricted to the production of complete rows of bricks but rather, can produce patterns of bricks so that a precast brick panel formed according to the invention can include sections without bricks for windows, doors or other facilities. For this, the spacing conveyor can move the bricks already loaded onto it a distance away from the leading or the adjacent end of the delivery conveyor, so that the next brick that is loaded onto the spacing conveyor is spaced from the last brick loaded onto the spacing conveyor, by the dimension of the opening required. This can be a multiple of 240 mm or 120 mm for example (1200 mm for a door opening for example). The spacing station will still use the leading ends of adjacent bricks to calculate the distance between adjacent bricks to provide an opening, even though in this circumstance, the distance between adjacent bricks will be much greater than the 240 mm spacing between adjacent bricks discussed above. The same principle applies in that it is the dimension of the overall length of the brick row that is intended to be consistent between brick rows.

The position of the sensor of the sensing arrangement can be at any position along the path of a brick where the brick being positioned is moving or movable relative to bricks that have already been spaced. What is required is that the relative position of the leading ends of adjacent bricks be established and once established, the accurate spacing of the bricks can be completed. For example, the sensor can sense the leading end of an incoming brick say at 1 m away from the leading end of an already positioned brick (the initial brick for example) and once it has sensed the leading end of the incoming brick, the further distance the incoming brick needs to travel relative to the already positioned brick can be calculated. In this example, the leading end of the incoming brick will need to travel towards the already positioned brick 760 mm to position the respective leading ends of the two bricks at a 240 mm spacing.

Suitable programming and software and hardware can be employed to control the brick movement and this is considered to be within the capability of a person skilled in that area.

The spacing station can include a push facility to push the last brick of a row of bricks to take the correct position in the row of bricks so as to correct any final error in the length of the row being formed. The use of a push facility recognises that any tolerance differences in the length of the last brick cannot be accommodated by variation in the distance between bricks, because there is no further brick beyond the last brick to provide compensation. Thus, the last brick in a row of bricks need not be accurately placed at first instance but rather, can be positioned adjacent the previous brick and the push facility can operate to push it to the final position in which the overall length of the row of bricks is accurate. The push facility can be set so that it will push the final brick so that the trailing or rear end of the final brick is positioned at a distance away from the forward or leading end of the initial brick which is equal to the desired length of the total brick row. Thus, where the overall length of the row is to be 2390 mm as given in the example above, the push facility will push the final brick so that the trailing or rear end of the final brick is positioned at a distance of 2390 mm away from the forward or leading end of the initial brick. If it happens that the final brick is already at that position, the operation of the push facility will not push the final brick at all. However, the invention can operate so that the final brick will always be positioned so that the row is formed to be of slightly greater length than the desired length of the total brick row before the push facility is operated. This prevents the final brick from being positioned at a point at which the length of the total brick row is less than the desired length of the total brick row. The preference is always for the final brick to be positioned at a point at which the length of the total brick row is slightly greater than the desired length of the total brick row, so that the push facility can push the final brick slightly inwardly to the desired length.

The distance the last brick of a row of bricks is shifted is based on knowledge of the position of the leading end of the initial brick and the total length of the brick row that is to be formed. The push facility can thus push the last brick into a position in which the trailing end of the last brick is at the maximum dimension of the brick row.

In some forms of the invention, the push facility includes a rotatable member or finger that has an inactive position in which it is spaced from the path of bricks within the spacing station and an active position in which it is rotated toward and into engagement with the trailing or rear end of the final brick to push the final brick as required. It will be appreciated that the distance the final brick is pushed can be in the order of only several or a few mm and so the distance is not great. The push facility can include a pair of rotatable members or fingers to engage opposite sides of the trailing or rear end of the final brick so that the final brick can be engaged evenly on the trailing or rear end.

The brick pattern assembly station receives rows of bricks from the spacing station and the rows are assembled on the support surface adjacent one another. The assembly of rows can be made in any suitable manner and in one form of the invention, a row of bricks is delivered to the assembly station by conveyor and is lifted as a row from the conveyor by a robot and placed on the support surface. After all of the rows have been placed on the support surface, the support surface can be removed from the assembly station and transported to a mortar or cement fill station at which mortar or cement can be poured over the brick pattern to finish the precast brick panel. Other fixings such as lifters, ferrules and reinforcement can be incorporated into the precast brick panel at the fill station. The support surface can include a rigid substrate such as a metal sheet on which a layer of flexible or malleable material such a rubber or foam is laid. The bricks advantageously can push, sink or depress into the layer of flexible or malleable material whereas the mortar or cement does not. This advantageously tends to retain the bricks still or stationary on the material. This also allows the front face of the bricks to sit slightly proud of the mortar or cement and to thus more closely resemble a traditional manually laid brick wall.

BRIEF DESCRIPTION OF DRAWINGS

In order that the invention may be more fully understood, some embodiments will now be described with reference to the figures in which.

DETAILED DESCRIPTION

Figure 1:
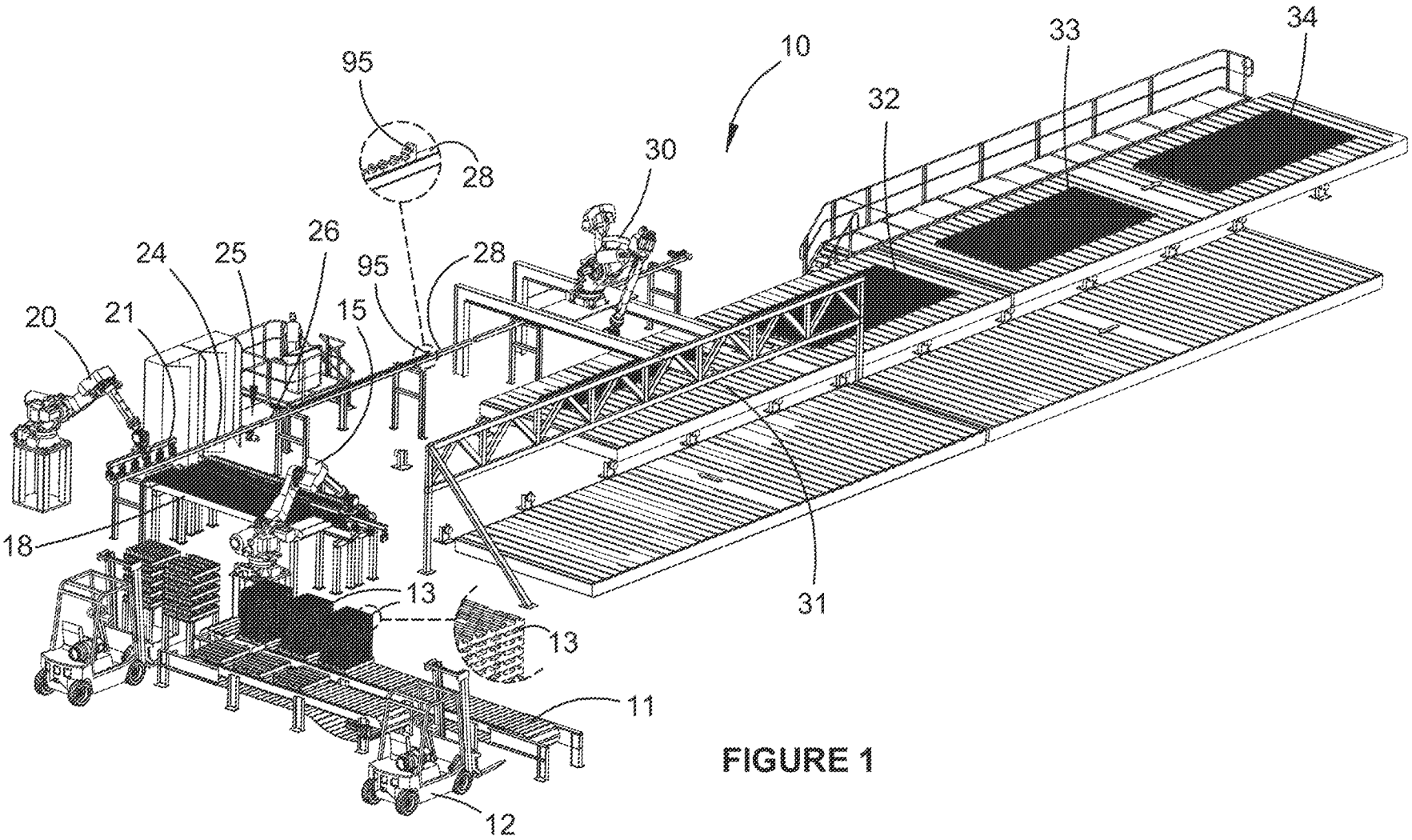
FIG. 1 is a layout drawing of an installation for assembling a brick pattern according to one embodiment of the present invention.

FIG. 1 is a layout drawing of an installation 10 for assembling a brick pattern according to one embodiment of the present invention for forming a precast brick panel. The installation has several sections at which different procedures take place as will be described hereinafter.

The installation 10 includes an infeed conveyor 11 which is fed by a forklift vehicle 12 with pallets of bricks 13. The pallets 13 can include either full or half bricks or a mixture of both, or indeed any size or form of bricks that are to be used.

A robot 15 is operable to grab and lift full and half bricks from the pallets 13. The robot 15 itself can be of a generally standard form as having six degrees of freedom, and can have a grabbing facility at the free end of the robot 15 that includes a series of individual grippers (these are not readily apparent in FIG. 1 but the grippers of the robot 15 are the same as the grippers 21 of the robot 20 that is described below). In FIG. 1, the grabbing facility includes six grippers, each for gripping a single brick, so that the grabbing facility can grip and lift up to six bricks at a time. Not all grippers need necessarily grip a brick each time the robot 15 takes bricks from the pallets 13 as the robot is programmed to selectively grab bricks so as to present them on an accumulation conveyer 18 for a subsequent selection by a loading robot 20. The robot 15 thus grabs and places full and half bricks on the accumulation conveyor 18 in a manner that facilitates access to full and half size bricks by the loading robot 20.

The loading robot 20 has the same construction as the robot 15, in that it also includes six grippers 21. The loading robot 20 is programmed to grab and lift bricks from the accumulation conveyor 18 for placement on a supply conveyor 24. The loading robot 20 might lift six bricks at one time and all being full size bricks, or it can lift less than six bricks and/or a mixture of full and half size bricks depending on the programme that the robot 20 is operating under.

The grippers 21 of the loading robot 20 are linearly aligned so that where it lifts multiple bricks, the bricks are linearly aligned. This allows the bricks lifted by the loading robot 20 to be laid on the supply conveyor 24 as discussed below.

The supply conveyor 24 can be termed a "linear" conveyor, in that it has a straight lengthwise axis. The supply conveyor 24 also has a width to accommodate the width of a single brick. The supply conveyor 24 is therefore long and thin. Neither being linear or of a width to accommodate the width of a single brick is essential, but is convenient in the installation 10 illustrated. The supply conveyor 24 is intended to provide bricks in a row for appropriate spacing at a spacing station, so that the bricks are spaced apart sufficiently for a mortar or cement solution to flow between them, and also for the entire row to be of a particular length for formation of a precast brick panel. The aim is to produce rows of bricks in which the row length is substantially the same for each row, so that rows of bricks can be formed or placed adjacent each other with opposite ends of adjacent rows being aligned. This consistency of row length has been a particular difficulty in prior art precast brick panels. Where rows of bricks have different lengths, even though the length variation might only be small and say within 5 mm to 15 mm, the aesthetic appearance of the brick panel can be adversely affected.

The supply conveyor 24 conveys bricks that have been loaded onto it by the loading robot 20 to a spacing station 25 that includes a sensor 26. The sensor 26 is positioned towards the end of the supply conveyor 24 and is operable to sense the forward or leading end of each brick that passes by it so that once the position of the forward end is known, the supply conveyor 24 can continue to convey the brick forward past the sensor 26 and onto a setting conveyor 28, which is co-linear with the supply conveyor 24 and which is separated from the end of the supply conveyor 24 by only a very small gap. Once the forward end of the brick reaches the setting conveyor 28, the setting conveyor is also driven to move so that the brick is driven by both conveyors 24 and 28 until the rear end of the brick leaves the supply conveyor 24 and drive of the brick is by the setting conveyor 28 only.

While the operation of the spacing station 25 will be discussed in greater detail in relation to FIG. 2, the installation 10 further includes a brick pattern assembly station which includes a setting robot 30 that can pick and lift a row of bricks that is presented to it on the setting conveyor 28. The setting robot 30 grabs or picks the entire row that is presented to it on the setting conveyor 28 and lifts the row onto a setting table 31. In FIG. 1, three setting tables have fully formed brick patterns shown at pattern numbers 32, 33 and 34. Each of the patterns 32 to 34 has been created by firstly forming separate rows of bricks through the spacing station 25 and delivering the formed rows via the setting conveyor 28 to the setting robot 30. Each row is then lifted from the setting conveyor 28 by the setting robot 30 onto a setting table and rows are added until a full brick pattern has been assembled. The brick pattern is then shifted away from the setting robot 30 as shown in relation to the patterns 32 to 34 and can later be lifted from the setting tables for delivery to a mortar or cement station for immersing the bricks in appropriate mortar or cement and for the application of other fittings relevant to the precast brick panel as required. For this, the brick patterns can be formed on a support surface, which can be a removable planar substrate which sits on the setting table and which can be lifted from the setting table. The support surface can include a rigid substrate such as a metal sheet or panel on which a layer of flexible or malleable material such a rubber or foam is laid. Alternatively, the setting tables themselves can be moved to the mortar station and delivered back once the mortar or cement has been poured and set and the brick panel has been formed.

Reference will now be made to the sequence of figures of FIG. 2 which illustrates how bricks that are placed on the supply conveyor 24 are spaced at the spacing station 25.

Figure 2:
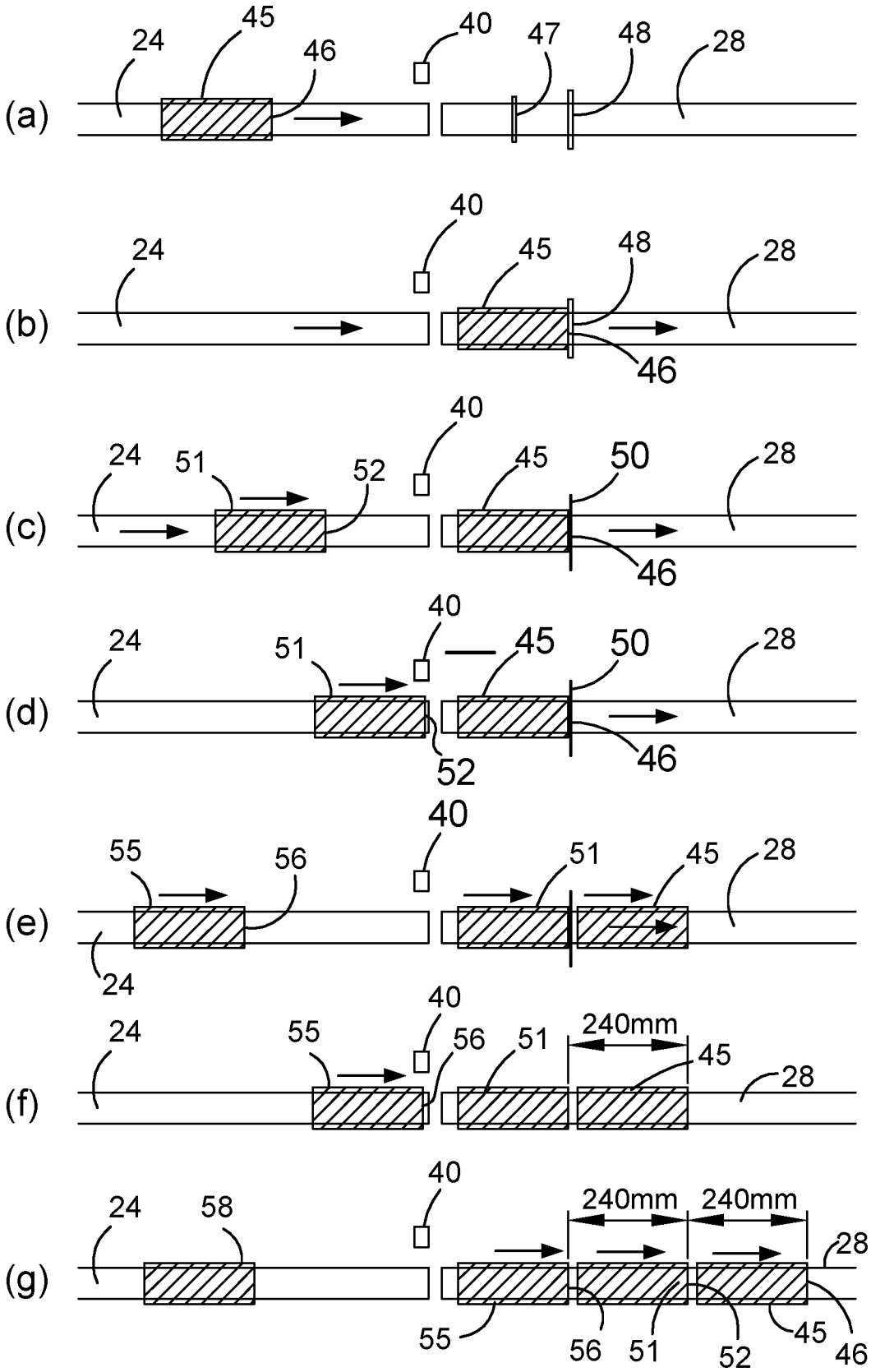
FIG. 2 is a sequence of figures which illustrates how bricks that are placed on the supply conveyor are spaced at a spacing station.

FIG. 2 schematically illustrates through a sequence of drawings a to g, a portion of the spacing station 25 that can space bricks in a row to a particular row length. The spacing station 25 of the invention that has been developed provides a high degree of accuracy for row length and advantageously that means that multiple rows of bricks can be formed to almost exactly the same length, which provides a highly aesthetic appearance in precast brick panels formed by the invention. FIG. 2 is not to scale.

The spacing station 25 incorporates a sensing arrangement that senses the forward end of a brick which is conveyed to the spacing station 25. In FIG. 2, the sensing arrangement includes a sensor 40 that is positioned at the leading end of the supply conveyor 24. The supply conveyor 24 is aligned axially with the setting conveyor 28 with a very slight gap between them so that the respective conveyors 24 and 28 can be rotated independently of each other.

The formation of a row of bricks involves delivery of individual bricks along the supply conveyor 24 and past the sensor 40. FIG. 2*a* shows a first brick 45 being moved along the supply conveyor 24 towards the sensor 40. For the purposes of the following discussion, the brick 45 and each of the other bricks that are shown in FIG. 2 are full size bricks that have a nominal length of 230 mm. As indicated above, the actual size of the brick can vary usually by ±3 mm.

In FIG. 2*a*, there are no bricks on the setting conveyor 28 at least in the region of the sensor 40. For the first brick 45, the sensor 40 is not required to sense the leading end 46. This is because for the first brick in a row of bricks, the leading end of the brick can be placed or located at a datum point from which the subsequent bricks are spaced. Thus, the first brick 45 can be delivered so that the leading end 46 of the brick engages either of the abutments 47 or 48, depending on whether the brick is a half or full brick. In FIG. 2, the bricks shown are full bricks and so it can be seen from FIG. 2*b*, that the leading end 46 of the brick 45 has engaged the abutment 48. The abutment 47 has been shifted out of the path of the brick 45 to allow the passage of the brick 45 to the abutment 48. Had the brick 45 been a half brick, the abutment 47 would have remained in place so that the leading end 46 would have engaged the abutment 47.

The abutments 47 and 48 are lowered into position from above prior to the first brick being delivered to the setting conveyor 28. The appropriate abutment is lowered depending on the size of the first brick that is to be delivered to it. This is part of the programming of the loading robot 20 that loads bricks onto the supply conveyor 24. The loading robot 20 is programmed to select the bricks required to form a row and will select full or half size bricks depending on requirements. For example, because adjacent rows of bricks of a brick panel are spaced apart half a brick, one of the adjacent rows necessarily requires a half brick within the row to form a row that has the same length as the adjacent row. The half brick is normally placed at either end of the row, although that is not essential. It follows, that if a row is to commence with a half brick, then the abutment 47 is lowered. Conversely, if a row is to commence with a full brick, then the abutment 48 is lowered.

Once the first brick has engaged the relevant abutment, its place on the setting conveyor 28 is established and the abutment can be raised or removed so that the first brick can be conveyed forward by the setting conveyor 28 as further bricks are introduced. A simple solenoid operation can be used to present and remove the abutments 47 and 48. The abutments 47 and 48 can be raised and lowered or moved laterally (sideways) to the axis of the supply and setting conveyors 24 and 28.

FIG. 2*c* illustrates the brick 45 in position on the setting conveyor 28 with the leading end 46 thereof at the datum point 50 (the datum point 50 is shown by an imaginary line) with the abutment 48 having been withdrawn. The brick 45 stationary on the setting conveyor 28. FIG. 2*c* also illustrates a second brick 51 moving towards the sensor 40 on the supply conveyor 24. When the leading end 52 of the brick 51 reaches the sensor 40 as shown in FIG. 2*d*, the sensor 40 senses the position of the leading end 52. This knowledge of the position of the leading end 52 is combined with the knowledge that the leading end 46 of the brick 45 is at the datum point 50 means that the supply and setting conveyors 24 and 28 can now operate together to shift the leading end 52 of the brick 51 to a position that is 240 mm spaced from the leading end 46 of the brick 45. Regardless of whether the brick 45 is actually 230 mm in length, or say 227 mm or 233 mm in length, the spacing between the respective leading ends will be 240 mm. The gap between the leading end 52 of the brick 51 and the trailing end 53 of the brick 45 will be 10 mm if the brick 45 is actually 230 mm in length, or it will be 13 mm or 7 mm if the brick is respectively 227 mm or 233 mm in length. But this variation in spacing is not of issue to the aesthetic appearance of the precast brick wall formed by the invention, but rather, of importance is that the length of the rows of bricks formed in the brick wall are of the same length and this is achieved as described hereinafter.

FIG. 2*e* shows the bricks 45 and 51 positioned adjacent each other on the setting conveyor 28. Thus, the brick 51 has been shifted by the supply conveyor 24 to the point at which it bridged the gap between the supply and setting conveyors 24 and 28 and moved onto the setting conveyor 28. The setting conveyor 28 has then commenced movement to shift both of the bricks 45 and 51 together. Thus, the brick 45 has shifted forward or along from its position in which its leading end 46 was at the datum point 50 and the leading end 52 of the brick 51 has shifted towards the datum point 50. FIG. 2*e* also shows a new brick 55 that was earlier placed on the supply conveyor 24 by the robot 20, moving towards the bricks 45 and 51 on the supply conveyor 24. So in FIG. 2*e*, both of the supply and setting conveyors 24 and 28 are moving.

FIG. 2*f* shows the brick 55 reaching the sensor 40, with the leading end 56 of the brick 55 being sensed by the sensor 40. The position of the leading end 56 is thus established and because the position of the leading end 52 of the brick 51 is known, the supply and setting conveyors 24 and 28 can operate together to shift the leading end 56 of the brick 55 to a position that is 240 mm spaced from the leading end 52 of the brick 51.

FIG. 2*g* shows the bricks 45, 51 and 55 in position on the setting conveyor 28 with the illustrated dimensions showing the 240 mm spacing between the leading ends 46 and 52, and the leading ends 52 and 56. This spacing can be achieved between successive bricks such as the brick 58 moving on the supply conveyor 24 towards the bricks 45, 51 and 55. The result is a row of bricks that have a 240 mm spacing between the leading ends of successive bricks for the length of the row. A row of 10 bricks will therefore have a length of 2390 mm. This is regardless of tolerance differences in the lengths of individual bricks. This contrasts with the normal manner of creating rows of bricks, which is to space the bricks apart 10 mm so that unless variations in brick length cancel themselves out over the full row, one row of bricks will have a different length to the next. In the present invention, consistent row length is established by accommodating the differences in the length of individual bricks in the gaps between adjacent bricks in the row.

Figure 3:
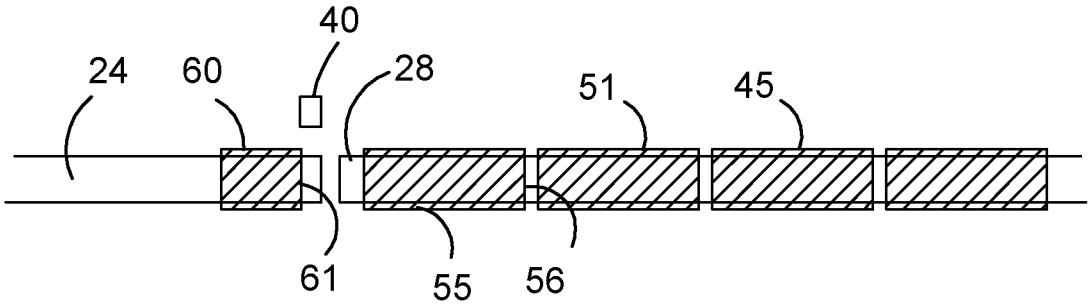
FIG. 3 shows an arrangement in which a brick row includes a half size brick.

The discussion above has been made in respect of the formation of a row of bricks that is uninterrupted and that consists entirely of full size bricks. Advantageously, the present invention can accommodate half size bricks in the row, as well openings in the row that are applied to accommodate in the formed brick panel, windows and doors. The present invention does this by the appropriate movement of the supply and setting conveyors 24 and 28. For example, FIG. 3 shows the three bricks 45, 51 and 55 of FIG. 2*g* in position, but with a half brick 60 replacing the full size brick 58. The brick 60 is just about at the sensor 40 and once there, the leading end 61 will be sensed and the supply and setting conveyors 24 and 28 will operate in the same manner as described hereinbefore in relation to the full size bricks with the spacing between the respective leading end 61 of the brick 60 and the leading end 56 of the brick 55 still being 240 mm. The spacing would change if the brick 60 was followed by a further brick, whereby the spacing between the leading end 61 of the brick 60 and the leading end of the following or successive brick will be 120 mm due to the half size of the brick 60.

Figure 4:
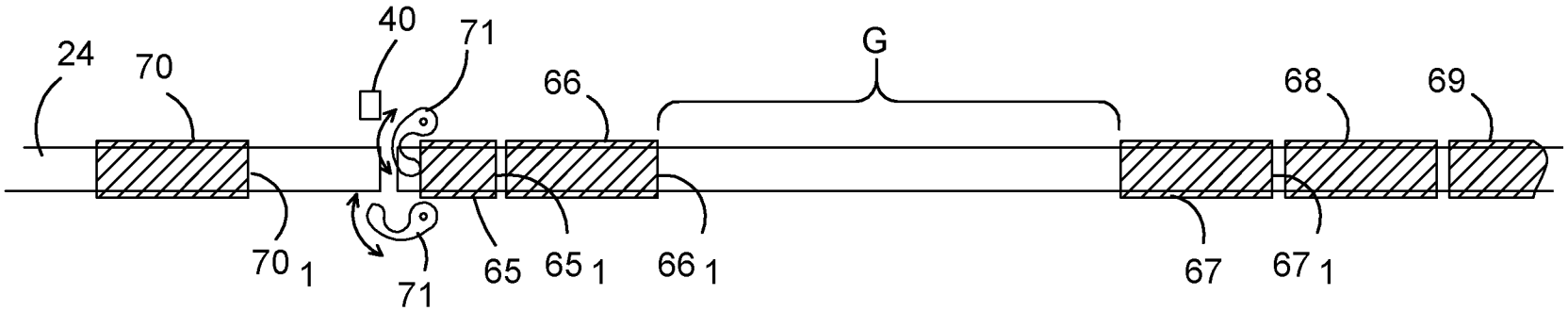
FIG. 4 shows an arrangement in which an opening is produced in a brick row.

An opening in a row to accommodate windows and doors is illustrated in FIG. 4. In FIG. 4, bricks 65 to 70 are shown, with brick 65 being a half size brick and bricks 66 to 70 being full size bricks. Bricks 67 to 69 have been positioned in the manner shown in FIG. 2*g* to form three adjacent bricks in which the respective leading ends are spaced 240 mm apart. However, the pattern of the precast brick panel that utilises the row of bricks shown in FIG. 4 includes a window opening G equivalent to the length of three bricks. To create this opening G, the movement of the supply and setting conveyors 24 and 28 is made to shift the bricks 67 to 69 3×240 mm before introducing the brick 66. The leading end $\mathbf{67}_1$ is therefore shifted 720 mm before the brick 66 is introduced behind it. The leading end $\mathbf{66}_1$ is therefore 720 mm behind or spaced from the leading end $\mathbf{67}_1$. Thereafter, the process operates as previously described whereby the leading end $\mathbf{65}_1$ of the brick 65 is introduced 240 mm behind the leading end $\mathbf{66}_1$ while the leading end 701 of the brick 70 is introduced 120 mm behind the leading end $\mathbf{65}_1$ of the brick 65.

The row of bricks of FIG. 4 would be repeated in several rows so that when adjacent rows are formed in a brick pattern, the opening that is formed has both width and depth.

It is to be noted that the illustration of a half size brick 65 is to show that a brick row can include both full and half size bricks and that half size bricks can be introduced at the end or ends of a row, or intermediate the ends. The half size bricks can also be introduced at the edges of openings that are formed in a row.

Returning to FIG. 1, the row of bricks that is formed at the spacing station 25 is conveyed to the setting robot 30 to be picked from the setting conveyor 28 and placed on a setting table 31. The setting patterns 32 to 34 are completed patterns, while the pattern being applied by the setting robot 30 to the setting table 31 is under construction.

A typical row of bricks could be 20 bricks long, while the number of adjacent rows in a brick could be 30 rows deep. As indicated above, once the brick pattern has been formed, it is transported or conveyed to a mortar or cement station for embedding the pattern in cement or mortar to form the precast brick panel.

The spacing station 25 can include a push facility to push the last brick of a row of bricks to take the correct position in the row of bricks so as to correct any final error in the length of the row being formed. Thus, the last brick in a row of bricks need not be accurately placed at first instance but rather, can be positioned adjacent the previous brick and the push facility can operate to push it to the final position in which the overall length of the row of bricks is accurate. The push facility can include a pair of rotatable members or fingers 71 (see FIG. 4) that have an inactive position spaced from the path of bricks within the spacing station 25 and an active position rotated toward and into engagement with the trailing or rear end of the final brick to push the final brick as required (see the movement indicated by the arrows associated with the respective fingers 71). The rotatable fingers 71 of FIG. 4 are separately shown in the active and inactive positions although they will always be in the same position, i.e. active or inactive, so that the different positions shown in FIG. 4 are for illustrative purposes only. Also, the fingers 71 are shown associated with the brick 65, which is not actually the final brick in a row and so again, FIG. 4 illustrates the operation of the fingers 71 but not in respect of a final brick as would be the case in practice. It will be appreciated that the distance the fingers 71 push a brick can be in the order of only several or a few mm and so the distance is not great.

Figure 5:
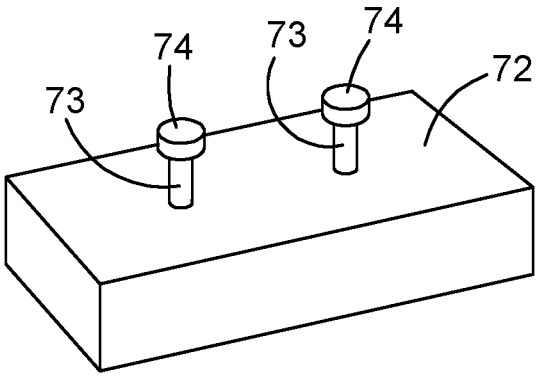
FIG. 5 shows one form of individual brick that can be employed in the present invention.

FIG. 5 illustrates a brick 72 for use in the present invention and which is shown upside down and in which a pair of posts 73 that have been embedded in the rear surface of the brick project outwardly from the rear surface and include a flared or widened head 74. These posts 73 assist to fix the brick 72 within the cement or mortar bed within which the bricks are embedded. That is, the flared or widened heads 74 of the posts 73 finds purchase within the cement or mortar bed resisting dislodgement of bricks from the precast brick panel once formed.

Figure 6A:
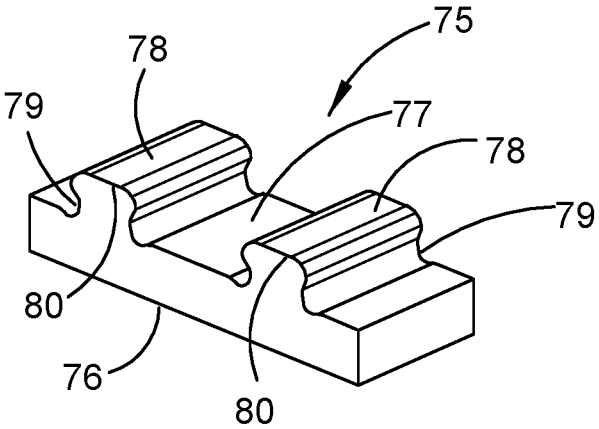
FIGS. 6*a* to 6*c* show further forms of individual bricks that can be employed in the present invention.
Figure 6B:
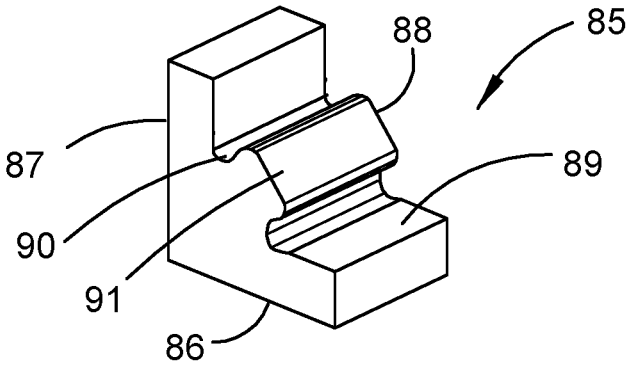
Figure 6C:
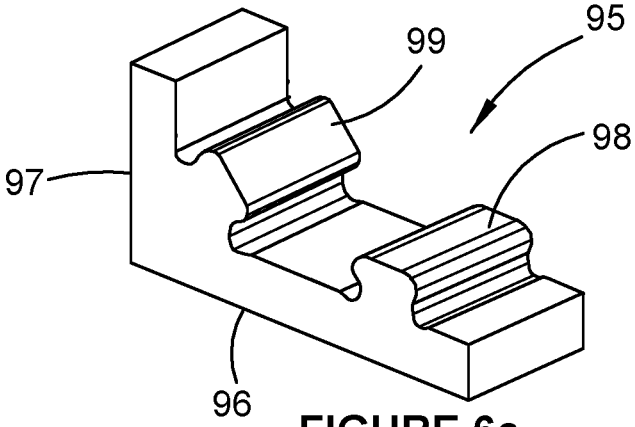

Alternatively, FIGS. 6*a* to 6*c* illustrates three alternative forms of brick that have been developed and that include interlocking or interengaging projections. The brick 75 of FIG. 6*a* has a flat front facia 76 that is exposed in the precast brick panel and a rear face 77 that is embedded in cement or mortar of the panel. For purchase within the cement or mortar bed, the brick 75 has a pair of shaped projections 78 that have a narrow neck 79 adjacent the rear face 77 that connects to a wider head 80. As will be readily appreciated, the cement or mortar bed will flow into the neck 79 which will resist dislodgement of the brick 75 from the precast brick panel once formed.

The brick 85 of FIG. 6*b* is a corner brick and so has a flat front facia 86 and a flat side facia 87 perpendicular to the front facia 86. Both facia are exposed in the precast brick panel. The brick 85 has a shaped projection 88 that extends from the inside corner of the rear face 89 and the projection 88 has a similar or is of substantially the same form as the projections 78 of the brick 75 of FIG. 6*a*. That is, the projection 88 has a narrow neck 90 that connects or extends to a wider head 91. As with the projections 78, the cement or mortar bed will flow into the neck 90 which will resisting dislodgement of the brick 85 from the precast brick panel once formed.

The brick 95 of FIG. 6*c* is another corner brick in which the front facia 96 has twice the length of the side facia 97. The brick 95 thus includes a projection 98 that is equivalent to the projections 78 of the brick 75 of FIG. 6*a*, and a projection 99 that is equivalent to the projection 88 of the brick 85 of FIG. 6*b*.

The installation illustrated and described in relation to the drawings has been found to form very accurate brick rows for producing very accurate brick patterns for subsequent immersion or embedding in mortar or concrete to form brick panels. The installation is highly automated and manual intervention is limited to the delivery of pallets of bricks to an infeed conveyor, such as by a forklift vehicle. The installation can thus run relatively autonomously without down time. The invention is anticipated to provide a breakthrough in the production of high quality and aesthetically pleasing precast brick panels, which have not been successfully commercialised before.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

Those skilled in the art will appreciate that the invention described herein is susceptible to variations and modifications other than those specifically described. It is understood that the invention includes all such variations and modifications which fall within the spirit and scope of the present invention.

The invention claimed is:

1. An installation for assembling a brick pattern for forming a precast brick panel, the installation comprising:

a. a conveyor, b. a spacing station, and c. a brick pattern assembly station, the conveyor being operable to convey a row of bricks to the spacing station, and the spacing station being operable to space the bricks apart in a row according to a predetermined row pattern and to a predetermined row length by allowing the spacing between adjacent bricks to vary, the spacing station including a push facility to push the last brick of a row of bricks into the correct position in the row of bricks, the push facility including a rotatable member or finger that has an inactive position in which it is spaced from the path of bricks within the spacing station and an active position in which it is rotated toward and into engagement with the trailing or rear end of the final brick to push the final brick as required, the brick pattern assembly station including a generally planar and horizontal support surface, the installation including facility to transfer the row of spaced bricks onto the generally planar and horizontal support surface of the brick pattern assembly station and the generally planar and horizontal support surface being capable of supporting a plurality of rows of spaced bricks assembled horizontally adjacent each other to form a multiple row brick pattern on the generally planar and horizontal support surface.

2. An installation according to claim 1, the conveyor being operable to convey bricks to the spacing station generally aligned along their longitudinal axis.

3. An installation according to claim 1, including an automated feed facility operable to feed bricks onto the conveyor in an orientation suitable to be spaced by the spacing station.

4. An installation according to claim 3, the orientation being in lengthwise or axial alignment.

5. An installation according to claim 1, including a robotic placement arrangement operable to feed bricks onto the conveyor, the robotic placement arrangement including a robot operable to pick up bricks from a brick supply and to place the bricks on the conveyor.

6. An installation according to claim 1, the spacing station incorporating a sensing arrangement that senses the forward or leading ends or faces of each brick being assembled into a row and which is operable to space the forward ends of adjacent bricks apart a selected amount.

7. An installation according to claim 1, the spacing station being operable to establish the position of the leading end or face of the initial brick and to bring the leading end or face of the next brick to a position spaced from the leading end or face of the initial brick a predetermined amount.

8. An installation according to claim 7, the predetermined amount being the sum of the average length of the bricks forming the row plus an average mortar gap.

9. An installation according to claim 7, the spacing station including a datum point at which the initial brick can be placed or located and from which the subsequent bricks are spaced.

10. An installation according to claim 1, the spacing station including two conveyors comprising a delivery conveyor and a spacing conveyor, wherein the delivery conveyor delivers bricks to the spacing station and the spacing conveyor delivers spaced bricks away from the spacing station.

11. An installation according to claim 10, the spacing conveyor includes an abutment for engagement by an initial brick.

12. An installation according to claim 11, the abutment being a retractable abutment that remains in place only to engage the initial brick and thereafter is retracted so as not to impede subsequent movement of the initial brick and subsequent bricks.

13. An installation according to claim 10, a sensor being operable to sense when the leading end of a next brick reaches the predetermined spacing relative to the initial brick and once the next brick has reached the predetermined spacing, either or both of the delivery and spacing conveyors being operable to shift the initial and next bricks together forward, so that the spacing between them remains as initially set.

14. An installation according to claim 1, the spacing station including a push facility to push the last brick of a row of bricks into the correct position in the row of bricks.

15. A method for assembling a brick pattern for forming a precast brick panel, the method comprising:

a. conveying bricks in a row to a spacing station, b. spacing the bricks apart in a row at the spacing station according to a predetermined row pattern and to a predetermined row length by allowing the spacing between adjacent bricks to vary, the bricks being spaced by a push facility that pushes the last brick of a row of bricks into the correct position in the row of bricks, the push facility including a rotatable member or finger that has an inactive position in which it is spaced from the path of bricks within the spacing station and an active position in which it is rotated toward and into engagement with the trailing or rear end of the final brick to push the final brick as required, c. transferring the row of spaced bricks onto a generally planar and horizontal support surface of a brick pattern assembly station, whereby a plurality of rows of spaced bricks are assembled horizontally adjacent each other on the generally planar and horizontal support surface of the brick pattern assembly station to form a multiple row brick pattern on the generally planar and horizontal support surface.

16. A method for forming a precast brick panel, the method comprising:

a. assembling a brick pattern by:

i. conveying bricks in a row to a spacing station, ii. spacing the bricks apart in a row at the spacing station according to a predetermined row pattern and to a predetermined row length by allowing the spacing between adjacent bricks to vary, the bricks being spaced by a push facility that pushes the last brick of a row of bricks into the correct position in the row of bricks, the push facility including a rotatable member or finger that has an inactive position in which it is spaced from the path of bricks within the spacing station and an active position in which it is rotated toward and into engagement with the trailing or rear end of the final brick to push the final brick as required, iii. transferring the row of spaced bricks onto a generally planar and horizontal support surface of a brick pattern assembly station, iv. assembling a plurality of rows of spaced bricks horizontally adjacent each other on the generally planar and horizontal support surface of the brick pattern assembly station to form a multiple row brick pattern on the generally planar and horizontal support surface, b. embedding the brick pattern in mortar or cement.

17. A method for forming a precast brick panel according to claim 16, including sensing the forward or leading ends or faces of each brick being assembled into a row and shifting each brick forward a predetermined distance relevant to the spacing required between bricks in the row of bricks being assembled and the length of the bricks.

* * * * *